US012611018B1

(12) United States Patent
Feng

(10) Patent No.: US 12,611,018 B1
(45) Date of Patent: Apr. 28, 2026

(54) SUITCASE TELESCOPIC HANDLE AND SUITCASE

(71) Applicant: Jiaxing Packdrop Luggage Technology Co., Ltd., Jiaxing (CN)

(72) Inventor: Tan Feng, Jiaxing (CN)

(73) Assignee: Jiaxing Packdrop Luggage Technology Co., Ltd., Jiaxing (CN)

( * ) Notice: Subject to any disclaimer, the term of this patent is extended or adjusted under 35 U.S.C. 154(b) by 0 days.

(21) Appl. No.: 19/237,756

(22) Filed: Jun. 13, 2025

(30) Foreign Application Priority Data

Dec. 31, 2024 (CN) ..... 202423322266.6

(51) Int. Cl.
*A45C 13/28* (2006.01)
*A45C 13/26* (2006.01)

(52) U.S. Cl.
CPC ..... *A45C 13/28* (2013.01); *A45C 13/262* (2013.01); *A45C 2013/267* (2013.01)

(58) Field of Classification Search
CPC .. A45C 13/28; A45C 13/262; A45C 2013/267
USPC ..... 190/102, 115; 16/405, 113.1; 150/111
See application file for complete search history.

(56) References Cited

U.S. PATENT DOCUMENTS 5,706,921 A * 1/1998 Wang ..... A45C 13/262 190/115
10,016,034 B2 * 7/2018 Lee ..... A45C 13/28
2002/0043544 A1 * 4/2002 Caneba ..... F16B 7/0493 224/584
2002/0043594 A1 * 4/2002 Kiry ..... A62C 33/04 248/80
2005/0279600 A1 * 12/2005 Goldwitz ..... A45C 13/262 16/113.1
2013/0264160 A1 * 10/2013 Mediamolle ..... A45C 13/28 190/102
2013/0313058 A1 * 11/2013 Yoshida ..... A45C 5/14 16/113.1
2020/0121051 A1 * 4/2020 Tong ..... A45C 13/28
2025/0176685 A1 * 6/2025 McKelvey ..... A45C 5/14

* cited by examiner

*Primary Examiner* — Sue A Weaver
(74) *Attorney, Agent, or Firm* — Hemisphere Law, PLLC

(57) ABSTRACT

A telescopic suitcase handle is provided, relating to the field of suitcase technologies. The telescopic suitcase handle includes telescopic rods, a handlebar, and a hanging rod assembly. The telescopic rods are provided two in quantity, the telescopic rods are connected to two ends of the handlebar respectively. The hanging rod assembly includes a sliding connector and a pair of fixed connectors, and the fixed connectors are arranged opposite to each other to define a gap therebetween. The sliding connector is slidably connected to one of the fixed connectors, and the sliding connector closes the gap by sliding toward another of the fixed connectors. The sliding connector opens the gap by sliding away from the another of the fixed connectors. The pair of fixed connectors are connected to the two ends of the handlebar respectively to make the hanging rod assembly and the handlebar form a closed frame structure.

10 Claims, 9 Drawing Sheets

SUITCASE TELESCOPIC HANDLE AND SUITCASE

TECHNICAL FIELD

The disclosure relates to the field of suitcase technologies, and more particularly to a suitcase telescopic handle and a suitcase.

BACKGROUND

A suitcase is a tool commonly used by people when traveling, carry-on items can be placed inside the suitcase for carrying and transporting.

However, when the suitcase is fully packed with luggage, items like umbrellas, drinks, snacks, or various large and small packages newly purchased during the travel that are placed on a top of the suitcase tend to fall off easily. As a result, travelers have to hold these items in one hand while pulling the suitcase with the other hand. Consequently, the travelers struggle to deal with various travel-related tasks, such as answering phone calls, passing through ticket checks, or undergoing a security check, as their hands are occupied, which leads to inconvenience or even a sense of being overwhelmed.

SUMMARY

A purpose of the disclosure is to provide a suitcase telescopic handle (also referred to as luggage telescopic handle) and a suitcase, so as to solve problems in the related art that when the suitcase is fully packed with luggage, items like umbrellas, drinks, snacks, or various large and small packages newly purchased during the travel that are placed on a top of the suitcase tend to fall off easily, travelers have to hold these items in one hand while pulling the suitcase with the other hand, and then the travelers struggle to deal with various travel-related tasks, such as answering phone calls, showing tickets, or conducting a security check, as their hands are occupied, leading to inconvenience or even a sense of being overwhelmed.

According to a first aspect of the disclosure, a suitcase telescopic handle is provided, including telescopic rods, a handlebar, and a hanging rod assembly.

The telescopic rods are two in quantity, the telescopic rods are connected to two ends of the handlebar respectively, and the telescopic rods are installed on a body of a suitcase.

The hanging rod assembly includes a sliding connector and a pair of fixed connectors, the pair of fixed connectors are arranged opposite to each other to define a gap therebetween, the sliding connector is slidably connected to one of the pair of fixed connectors, the sliding connector is capable of closing the gap by sliding toward another of the pair of fixed connectors, and the sliding connector is capable of opening the gap by sliding away from the another of the pair of fixed connectors.

The pair of fixed connectors are connected to the two ends of the handlebar respectively to make the hanging rod assembly and the handlebar form a closed frame structure configured to hang items.

Alternatively, the pair of fixed connectors are connected to that the telescopic rods to make the hanging rod assembly, the telescopic rods and the handlebar form a closed frame structure configured to hang the items.

Alternatively, the one of the pair of fixed connectors is connected to the handlebar and the another of the pair of fixed connectors is connected to one of the telescopic rods to make the hanging rod assembly, one of the telescopic rods and the handlebar form a closed frame structure configured to hang the items.

In an embodiment, the pair of fixed connectors are fixed rods, and the sliding connector is a sliding sleeve.

An end of the sliding sleeve is sleeved onto one of the fixed rods; another end of the sliding sleeve is capable of being sleeved onto another of the fixed rods to close the gap by sliding the another of the fixed rods; and the another end of the sliding sleeve is capable of being disengaged from the another of the fixed rods to open the gap by sliding away from the another of the fixed rods.

In an embodiment, the pair of fixed connectors are fixed sleeves, and the sliding connector is a sliding rod.

An end of the sliding rod is inserted into one of the fixed sleeves, another end of the sliding rod is capable of being inserted into another of the fixed sleeves to close the gap by sliding toward the another of the fixed sleeves; and the another end of the sliding rod is capable of being disconnected from the another of the fixed sleeves to open the gap by sliding away from the another of the fixed sleeves.

In an embodiment, the hanging rod assembly further includes a spring.

The spring is disposed between the sliding connector and the one of the pair of fixed connectors slidably connected to the sliding connector, and the spring is configured to provide a force to drive the sliding connector to slide toward the another one of the pair of fixed connectors.

In an embodiment, the hanging rod assembly further includes a protruding part disposed on the sliding connector, and the protruding part is located within the closed frame structure.

In an embodiment, the hanging rod assembly further includes a limiting structure, the limiting structure is disposed between the sliding connector and the one of the pair of fixed connectors slidably connected to the sliding connector, the limiting structure is configured to limit the sliding connector to disengage from the one of the pair of fixed connectors that slidably connected to the sliding connector.

In an embodiment, when the telescopic rods are retracted relative to the suitcase, a clearance is defined between the hanging rod assembly and a top surface of the suitcase.

In an embodiment, the suitcase telescopic handle further includes a handle base, the handle base is disposed on the body of the suitcase, and the telescopic rods are disposed on the handle base; and when the telescopic rods are retracted relative to the handle base, a clearance is defined between the hanging rod assembly and the handle base.

According to a second aspect of the disclosure, a suitcase is provided, including the body of the suitcase and at least one suitcase telescopic handle of the disclosure.

In an embodiment, the suitcase telescopic handle is disposed on one of a front side surface and a rear side surface of the body of the suitcase.

In an embodiment, a groove is defined on a top surface of the body of the suitcase, the suitcase telescopic handle is located at the groove, the groove is configured to accommodate the handlebar and the hanging rod assembly.

Compared with the related art, technical advantages of the suitcase telescopic handle and the suitcase provided by the disclosure are as follows.

The disclosure provides the telescopic suitcase handle, which includes the telescopic rods, the handlebar, and the hanging rod assembly. The telescopic rods are provided two in quantity, and the telescopic rods are connected to two ends of the handlebar respectively. The telescopic rods are installed on the body of the suitcase. The hanging rod assembly includes the sliding connector and the pair of fixed connectors, and the pair of fixed connectors are arranged opposite to each other to define a gap therebetween. The sliding connector is slidably connected to one of the pair of fixed connectors, and the sliding connector is capable of closing the gap by sliding toward another of the pair of fixed connectors. The sliding connector is capable of opening the gap by sliding away from the another one of the fixed connectors. The pair of fixed connectors are connected to the two ends of the handlebar respectively to make the hanging rod assembly and the handlebar form a closed frame structure configured to hang items. Alternatively, the pair of fixed connectors are connected to the telescopic rods respectively to make the hanging rod assembly, the two telescopic rods and the handlebar form a closed frame structure configured to hang the items. Alternatively, the one of the pair of fixed connectors is connected to the handlebar and the another of the pair of fixed connectors is connected to one of the telescopic rods to make the hanging rod assembly, the one of the telescopic rods and the handlebar form a closed frame structure configured to hang the items.

When in use, the gap can be opened by sliding the sliding connector, allowing the closed frame structure to be opened, and enabling users to conveniently hang the multiple items such as small handbags, umbrellas, snacks, and water bottles on the hanging rod assembly. Then, close the gap by sliding the sliding connector again, so as to close the closed frame structure. Therefore, hands of the users can be freed up for other travel-related tasks like answering calls, ticket checking or shopping to avoid being flustered and disorganized and save efforts. During passing a security checking, the telescopic rods are capable of being retracted, therefore the body of the suitcase and the bags mentioned above can be placed on the security conveyor belt together to pass the security check. This also avoid a scattering and a loss of trivial items and avoid a congestion caused by people queuing up for security checks for too long. The hanging rod assembly is mounted on the handlebar and the telescopic rods, or hanging rod assembly is mounted on the handlebar or the telescopic rods, occupying no storage space within the body of the suitcase and adding no volume to the body of the suitcase, and also does not affect an appearance, a storage, a carriage, a boarding or a checking-in of the suitcase. When the suitcase telescopic handle is extended, the hanging rod assembly rises and can be closer to an upper body of the user, enabling easy access to the items while walking or waiting in line without bending down, so as to enhance humanization. Additionally, the closed frame structure has a gap between the handlebar and the hanging rod assembly, allowing the hands of the users to grip the handlebar.

The suitcase provided in the disclosure includes the above-mentioned suitcase telescopic handle. Therefore, the suitcase achieves the same technical advantages and effects as the suitcase telescopic handle, which will not be repeated here.

Other features and advantages of the disclosure will be elaborated in detail in a subsequent detailed description of the embodiments.

BRIEF DESCRIPTION OF DRAWINGS

In order to more clearly describe specific embodiments of the disclosure or technical solutions in the related art, a brief introduction to attached drawings required in the description of the specific embodiments or the related art will be given below. Apparently, the attached drawings described below are some embodiments of the disclosure. For those skilled in the art, other drawings can also be obtained based on these attached drawings without making creative efforts.

DESCRIPTION OF REFERENCE SIGNS

Figure 1:
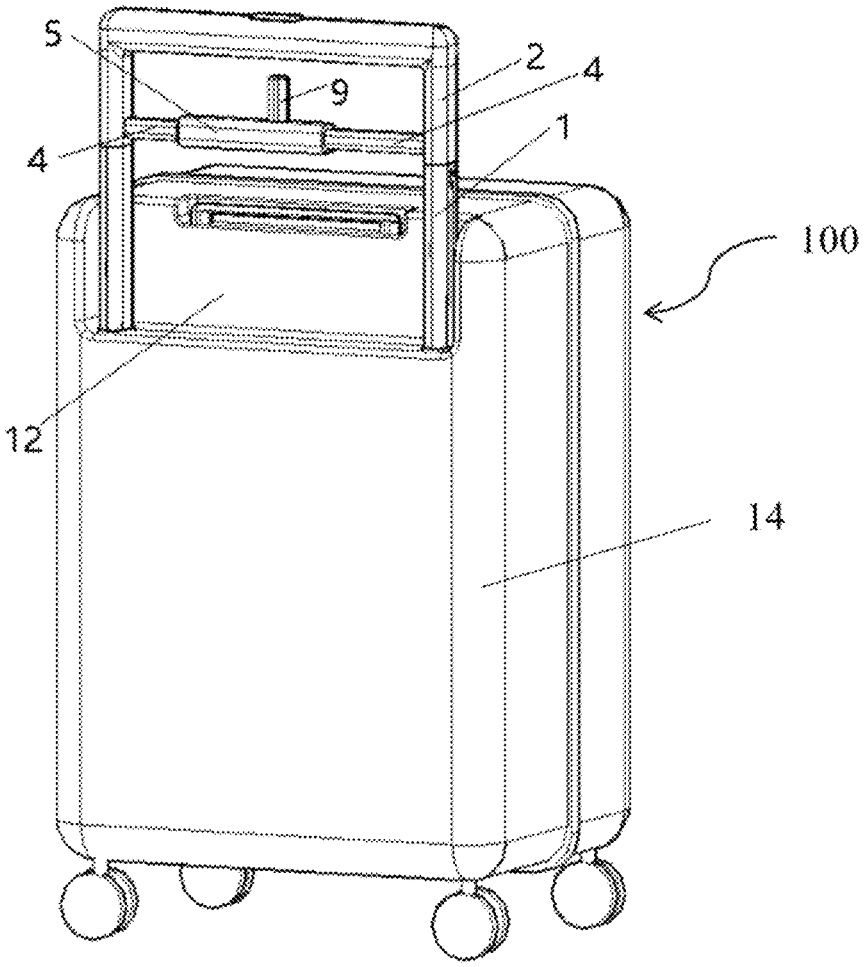
FIG. 1 illustrates a schematic structural diagram of a suitcase telescopic handle when telescopic rods extend out and a sliding sleeve closes a gap according to an embodiment of the disclosure.

1—telescopic rod; 2—handlebar; 3—gap; 4—fixed rod; 5—sliding sleeve; 6—fixed sleeve; 7—sliding rod; 8—spring; 9—protruding part; 10—slot hole; 11—clearance; 12—groove; 13—handle base; 14—body of a suitcase; 100—suitcase.

DETAILED DESCRIPTION OF EMBODIMENTS

In the following description, technical solutions of the disclosure will be described clearly and completely with embodiments of the disclosure. Apparently, the illustrated embodiments are a part of the embodiments of the disclosure, but not all of the whole embodiments. Based on the embodiments of the disclosure, all other embodiments obtained by those skilled in the art without creative work are within the scope of the disclosure.

In the following description of the embodiments of the disclosure, terms related to orientation, such as "center", "upper", "lower", "left", "right", "vertical", "horizontal", "inner", "outer", etc. indicating an orientation or positional relationship are based on the orientation or positional relationship shown in the drawings, and are only for the convenience of describing the disclosure. It is not intended to indicate or imply that devices or elements referred to must have a particular orientation, be constructed or operate in a particular orientation, and therefore, should not be construed as limiting the disclosure. Furthermore, the terms "first", "second", and "third" are only used for descriptive purposes and should not be understood as indicating or suggesting relative importance.

In the description of the embodiments of the disclosure, it should be noted that, unless otherwise explicitly stipulated and limited, the terms "install", "connect" and "link" should be understood in a broad sense, for example, it can be a fixed connection, a detachable connection, or an integral connection; it can be a mechanical connection or an electrical connection. It can be directly connected, indirectly connected through an intermediate medium, or internally connected between two components. For those skilled in the art, the specific meanings of the above terms in the embodiments of the disclosure can be understood in specific circumstances.

In addition, the technical solutions of each embodiment can be combined with each other, but it must be based on the fact that it can be implemented by those skilled in the art. When the combination of technical solutions is contradictory or cannot be achieved, it should be considered that such a combination of technical solutions does not exist and is not within the protection scope required by the disclosure.

The following is a detailed description of the disclosure with reference to the drawings and specific embodiments.

Figure 2:
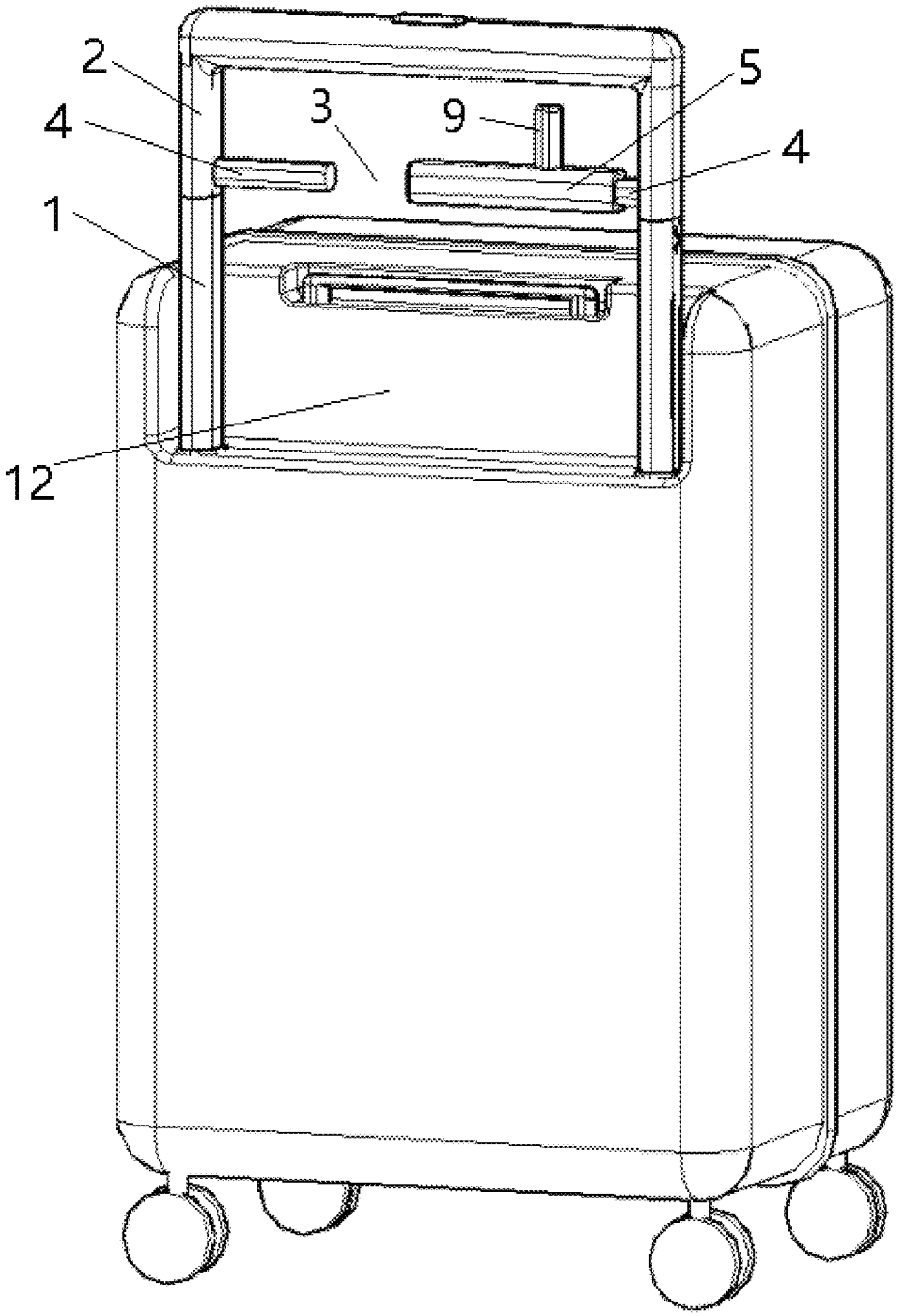
FIG. 2 illustrates a schematic structural diagram of the suitcase telescopic handle when the telescopic rods extend out and the sliding sleeve opens the gap according to the embodiment of the disclosure.
Figure 3:
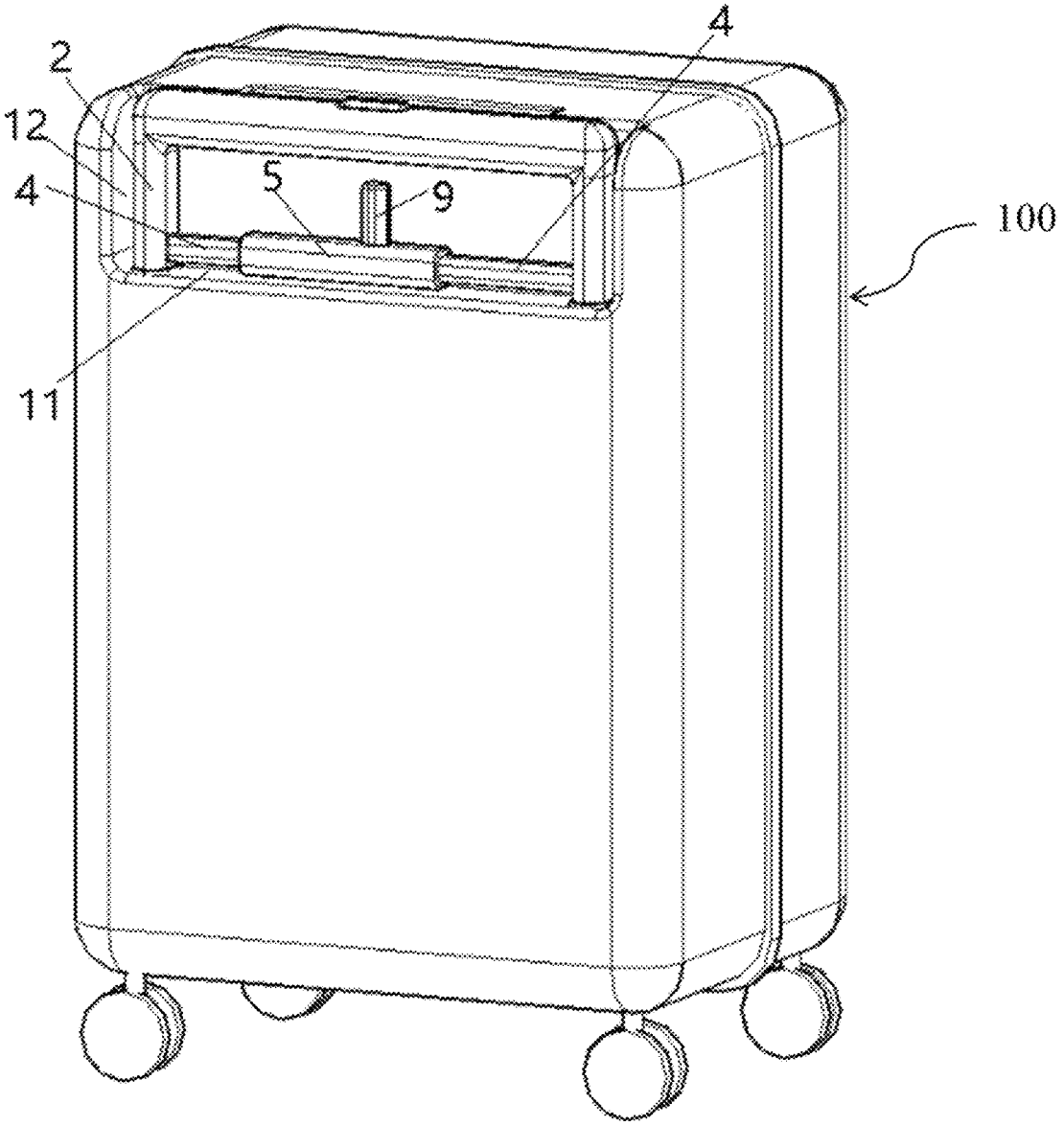
FIG. 3 illustrates a schematic structural diagram of the suitcase telescopic handle when the telescopic rods retract and the sliding sleeve closes the gap according to the embodiment of the disclosure.
Figure 4:
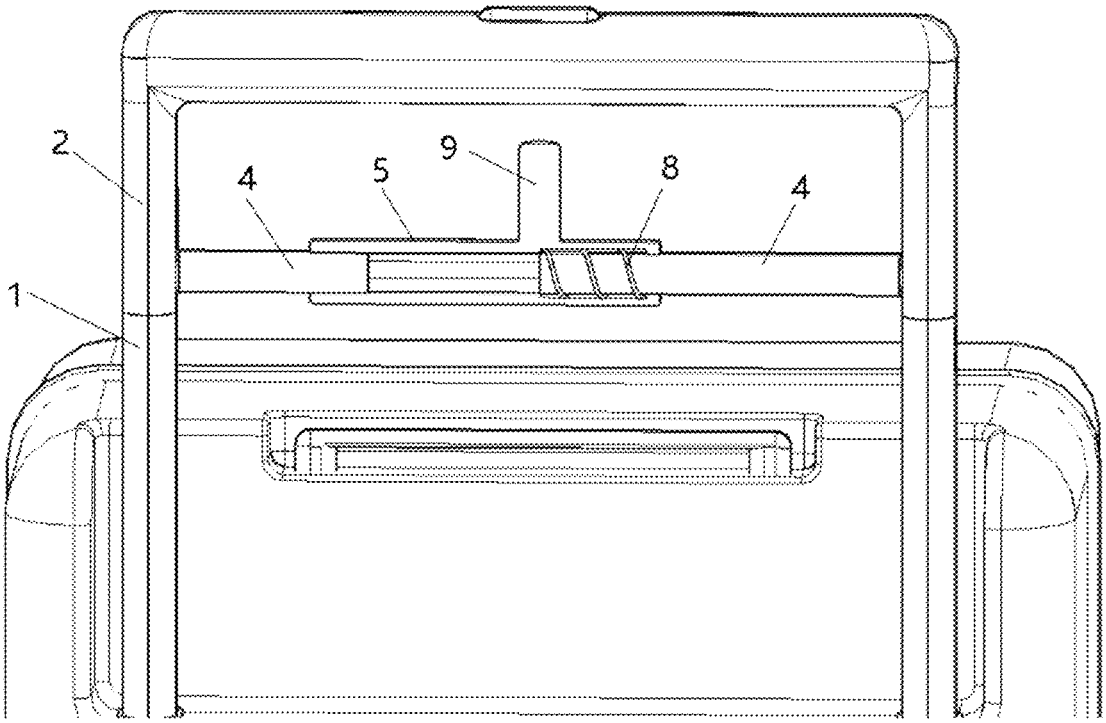
FIG. 4 illustrates a sectional view of the suitcase telescopic handle when the sliding sleeve closes the gap according to the embodiment of the disclosure.
Figure 5:
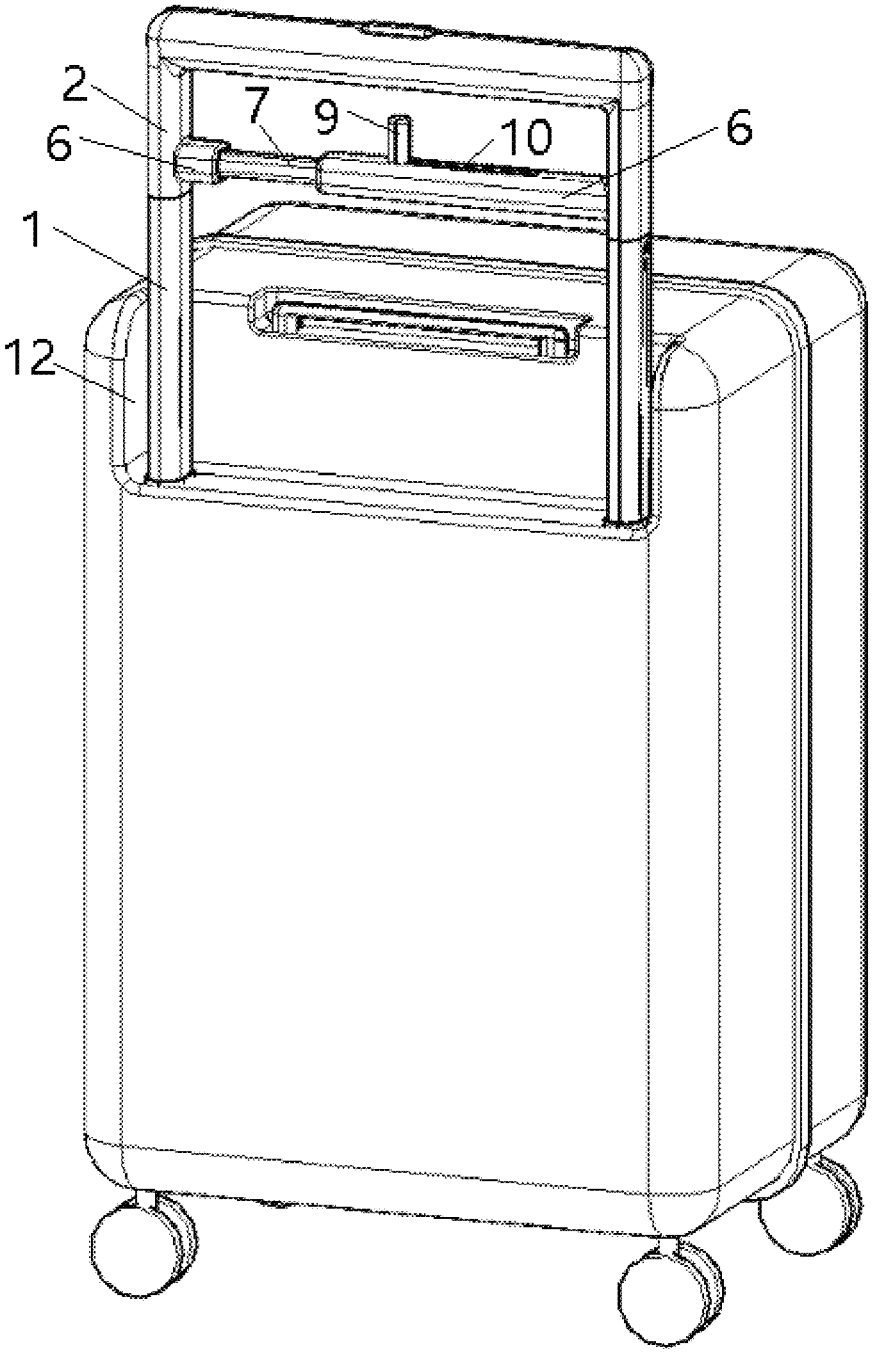
FIG. 5 illustrates a schematic structural diagram of a suitcase telescopic handle when telescopic rods extend out and a sliding rod closes a gap according to another embodiment of the disclosure.
Figure 6:
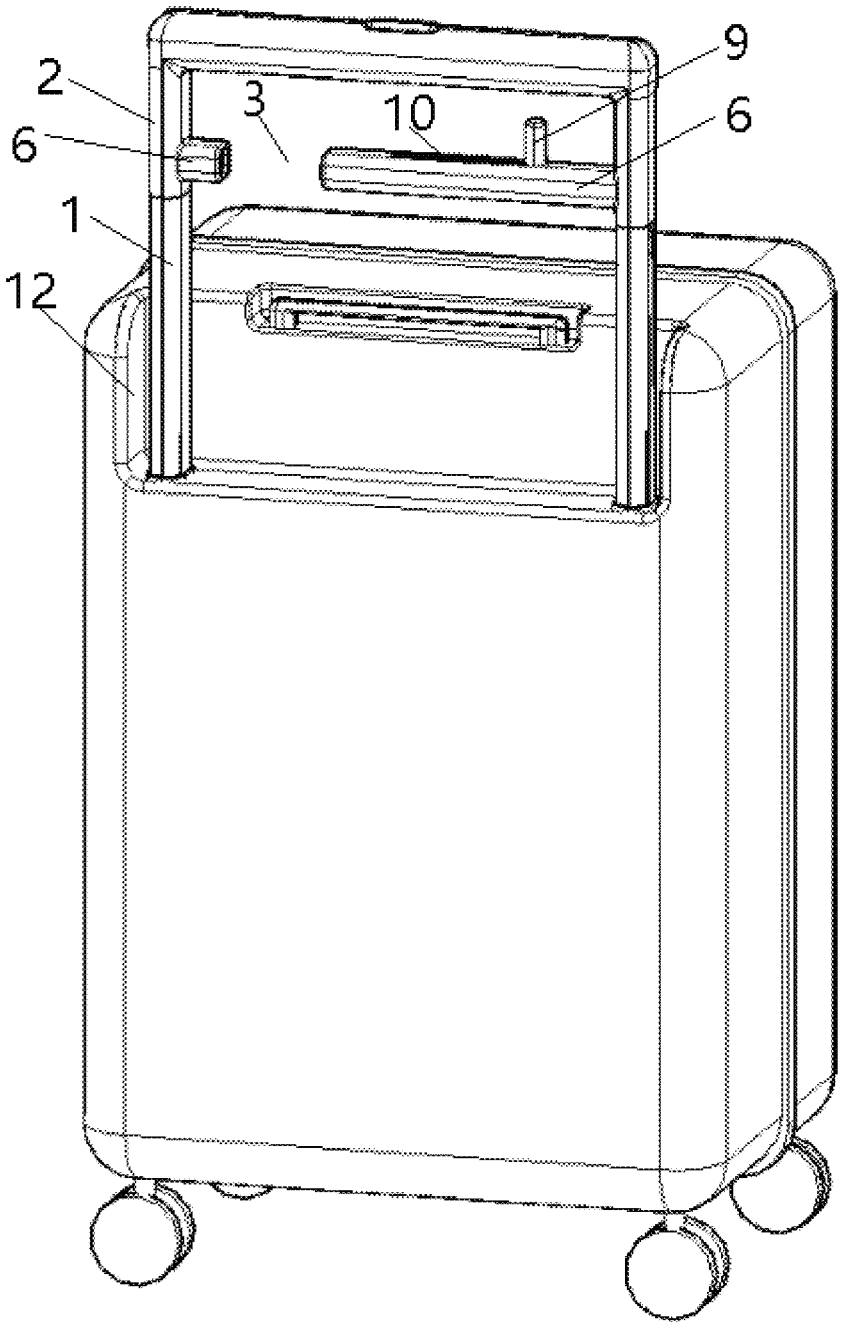
FIG. 6 illustrates a schematic structural diagram of the suitcase telescopic handle when the telescopic rods extending out and the sliding rod opens the gap according to the another embodiment of the disclosure.
Figure 7:
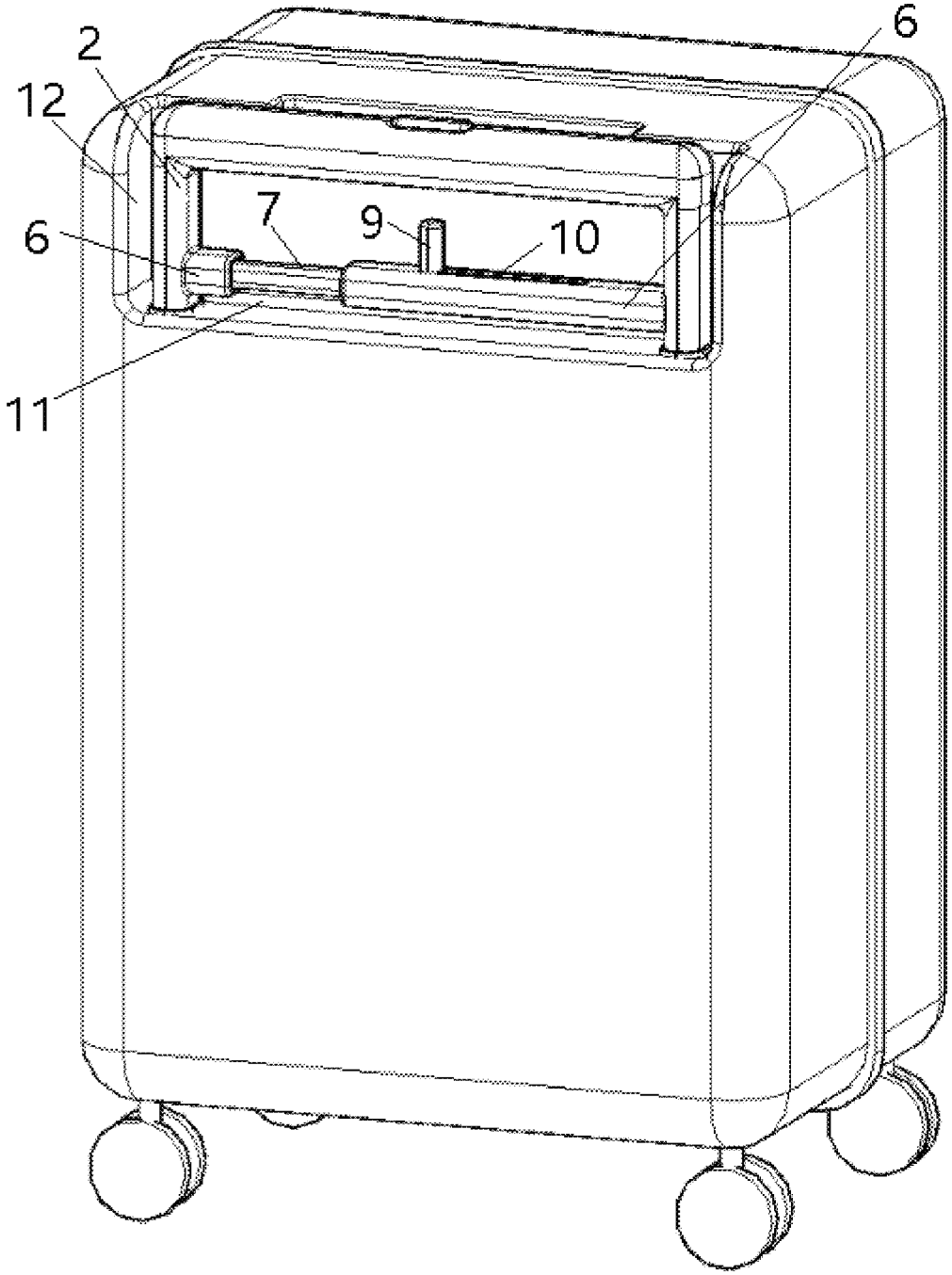
FIG. 7 illustrates a schematic structural diagram of the suitcase telescopic handle when the telescopic rods retract and the sliding sleeve closes the gap according to the another embodiment of the disclosure.
Figure 8:
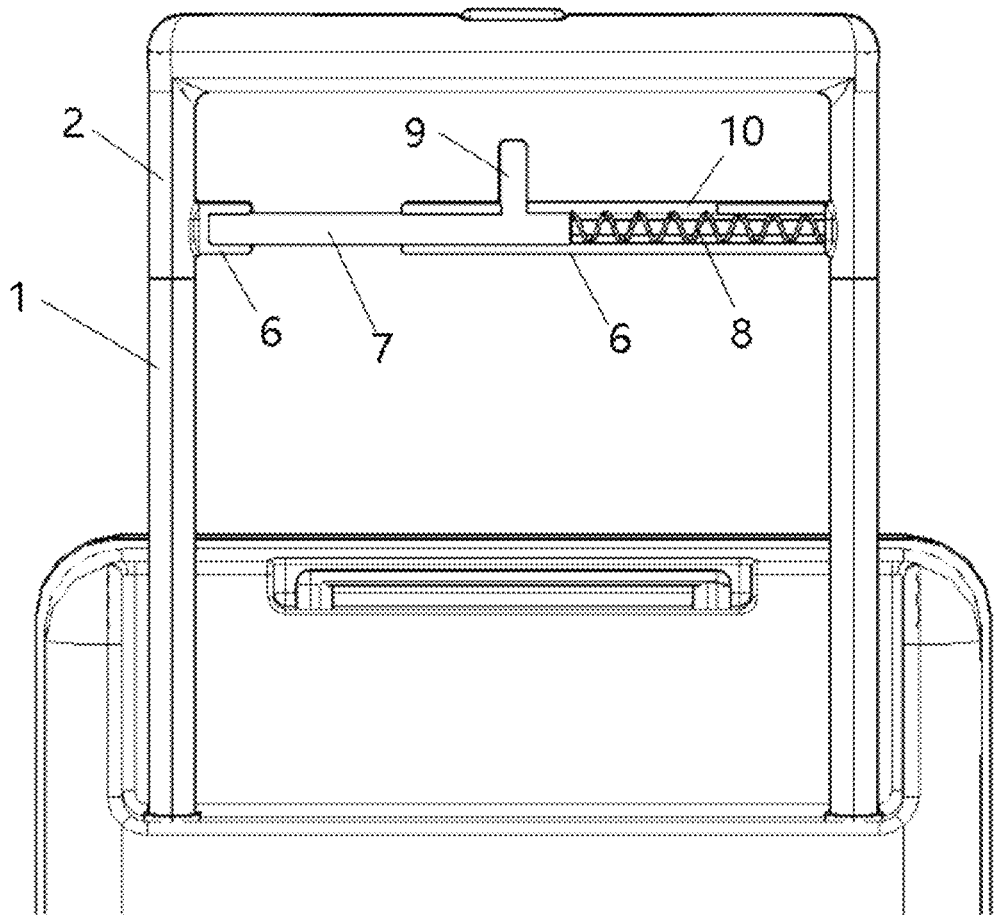
FIG. 8 illustrates a sectional view of the suitcase telescopic handle when the sliding sleeve closes the gap according to the another embodiment of the disclosure.
Figure 9:
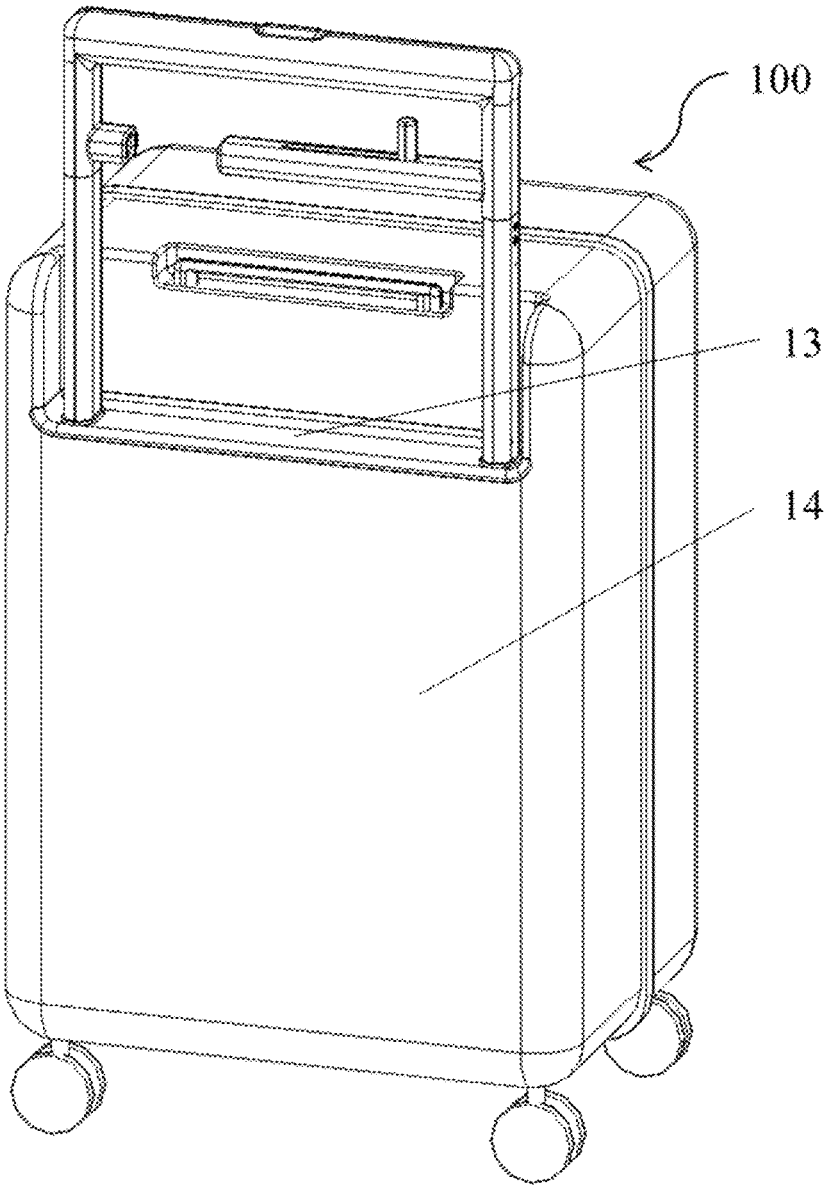
FIG. 9 illustrates a schematic structural diagram of a suitcase.

The specific structure is shown in FIGS. 1 to 9.

The disclosure provides a telescopic suitcase handle, which includes telescopic rods 1, a handlebar 2, and a hanging rod assembly. The telescopic rods 1 are provided two in quantity, the telescopic rods 1 are connected to two ends of the handlebar 2 respectively. The telescopic rods 1 are installed on a body of a suitcase 14. The hanging rod assembly includes a sliding connector and a pair of fixed connectors, and the pair of fixed connectors are arranged opposite to each other to define a gap 3 therebetween. The sliding connector is slidably connected to one of the pair of fixed connectors, and the sliding connector is capable of closing the gap 3 by sliding toward another of the pair of fixed connectors. The sliding connector is capable of opening the gap 3 by sliding away from the another one of the fixed connectors. The pair of fixed connectors are connected to the two ends of the handlebar 2 respectively to make the hanging rod assembly and the handlebar 2 form a closed frame structure configured to hang items. Alternatively, the pair of fixed connectors are connected to the telescopic rods 1 respectively to make the hanging rod assembly, the two telescopic rods 1 and the handlebar 2 form a closed frame structure configured to hang the items. Alternatively, the one of the pair of fixed connectors is connected to the handlebar 2 and the another of the pair of fixed connectors is connected to one of the telescopic rods 1 to make the hanging rod assembly, the one of the telescopic rods 1 and the handlebar 2 form a closed frame structure configured to hang the items.

In an embodiment, when in use, the gap 3 can be opened by sliding the sliding connector, allowing the closed frame structure to be opened, and enabling users to conveniently hang the multiple items such as small handbags, umbrellas, snacks, and water bottles on the hanging rod assembly. Then, the gap 3 can be closed by sliding the sliding connector, so as to close the closed frame structure. Therefore, hands of the users can be freed up for other travel-related tasks like answering calls, ticket checking or shopping to avoid being flustered and disorganized and save efforts. During passing a security checking, the telescopic rods 1 are capable of being retracted, therefore the body of the suitcase 14 and the bags mentioned above can be placed on the security conveyor belt together to pass the security check. This also avoids a scattering and a loss of trivial items and avoids a congestion caused by people queuing up for security checks for too long. The hanging rod assembly is mounted on at least one of the handlebar 2 and the telescopic rods 1, occupying no storage space within the body of the suitcase 14 and adding no volume to the body of the suitcase 14, and also does not affect an appearance, a storage, a carriage, a boarding or a checking-in of a suitcase 100. When the suitcase telescopic handle is extended, the hanging rod assembly rises and can be closer to an upper body of the user, enabling easy access to the items while walking or waiting in line without bending down, so as to enhance humanization. Additionally, the closed frame structure has a gap between the handlebar 2 and the hanging rod assembly, allowing the hands of the users to grip the handlebar 2.

In an alternative embodiment, the pair of fixed connectors are fixed rods 4, and the sliding connector is a sliding sleeve 5. An end of the sliding sleeve 5 is sleeved onto one of the pair of fixed rods 4. By sliding the sliding sleeve 5 toward another of the pair of fixed rods 4, another end of the sliding sleeve 5 can be sleeved onto the another one of the fixed rods 4 to close the gap 3. By sliding the sliding sleeve 5 away from the another of the pair of fixed rods 4, the another end of the sliding sleeve 5 can be disengaged from the another of the pair of fixed rods 4 to open the gap 3. The technical solution is simple in structure, and the opening and the closing of the gap 3 are convenient and stable.

In an alternative embodiment, the pair of fixed connectors are fixed sleeves 6, and the sliding connector is a sliding rod 7. An end of the sliding rod 7 is inserted into one of the pair of fixed sleeves 6. By sliding the sliding rod 7 toward another one of the fixed sleeves 6, another end of the sliding rod 7 can be inserted into the another of the pair of fixed sleeves 6 to close the gap 3. By sliding the sliding rod 7 away from the another of the pair of fixed sleeves 6, the another end of the sliding rod 7 can be disengaged from the another one of the fixed sleeves 6 to open the gap 3. The technical solution is simple in structure, and the opening and the closing of the gap 3 are convenient and stable.

In an alternative embodiment, the hanging rod assembly further includes a spring 8, which is disposed between the sliding connector and the one of the pair of fixed connectors that slidably connected to the sliding connector. The spring 8 is configured to provide a force to drive the sliding connector to slide toward the another of the pair of fixed connectors.

In the embodiment, by setting the spring 8, the spring 8 keeps the sliding connector in an initial position where the gap 3 is closed. When there is a need of use, the user can manually slide the sliding connector to open the gap 3, and at this time the spring 8 is compressed. After the items are hung, the user releases the sliding connector to allow the spring 8 to automatically return it to the initial position where the gap 3 is closed, ensuring convenience, and an effect of closing the gap 3 is good and can prevent hanging bags from dropping out.

In an alternative embodiment, the hanging rod assembly further includes a protruding part 9 disposed on the sliding connector, and the protruding part 9 is located within the closed frame structure.

In the embodiment, the protruding part 9 can be pulled by the hands of the users to slide the sliding connector, which is convenient to use.

It should be noted that when the fixed connector is the fixed sleeve 6 and the sliding connector is the sliding rod 7, the one of the fixed sleeves 6 connected to the sliding rod 7 defines a slot hole 10. The protruding part 9 is threaded through the slot hole 10 to make the protruding part 9 to be located within the closed frame structure. The technical solution is simple in structure and convenient to manufacture.

In an alternative embodiment, the hanging rod assembly includes a limiting structure located between the sliding connector and the one of the fixed connectors that slidably connected to the sliding connector. The limiting structure is configured to limit the sliding connector to disengage from the one of the pair of fixed connectors that slidably connected to the sliding connector.

In the embodiment, the limiting structure can be a first protrusion which is disposed on a side wall of the sliding connector and a second protrusion which is disposed on the fixed connector. The first protrusion and the second protrusion correspond with each other. When the first protrusion and the second protrusion contact with each other, the sliding connector can be limited to continue to slide relative to the pair of fixed connectors, so as to avoid the sliding connector to detach from the pair of fixed connectors. Alternatively, the limiting structure can be a first convex ring which is disposed on the side wall of the sliding connector and a second convex ring which is disposed on the fixed connector. When the first convex ring and the second convex ring contact with each other, the sliding connector can be limited to continue to slide relative to the pair of fixed connectors, so as to avoid the sliding connector to detach from the pair of fixed connectors.

It should be noted that when the fixed connector is the fixed sleeve 6 and the sliding connector is the sliding rod 7, the protruding part 9 and slot hole 10 can serve as the limiting structure, so as to be simple in structure and easy to manufacture.

In an alternative embodiment, when the telescopic rods 1 are retracted relative into the suitcase 100, a clearance 11 is defined between the hanging rod assembly and a top surface of the body of the suitcase 14. Alternatively, the suitcase telescopic handle further includes a handle base 13, the handle base 13 is mounted on the body of the suitcase 14, and the telescopic rods 1 are disposed on the handle base 13. When the telescopic rods 1 are retracted relative into the handle base 13, a clearance 11 is defined between the hanging rod assembly and the handle base 13.

In the embodiment, the clearance 11 is defined when the telescopic rods 1 are retracted into the handle base 13, which is convenient to accommodate handles of the bags.

The suitcase 100 is provided in the disclosure, the suitcase 100 includes the body of the suitcase 14 and the aforementioned suitcase telescopic handle. Therefore, the suitcase 100 achieves the same technical advantages and effects as the suitcase telescopic handle, which will not be repeated here.

In an alternative embodiment, the suitcase telescopic handle is disposed on one of a front side surface or a rear side surface of the body of the suitcase 14, which is convenient to pull the body of the suitcase 14.

In an alternative embodiment, a groove 12 is defined on a top surface of the body of the suitcase 14. The suitcase telescopic handle is located at the groove 12. The groove 12 is configured to accommodate the handlebar 2 and the hanging rod assembly.

In the embodiment, when the telescopic rods 1 are retracted, the handlebar 2 and the hanging rod assembly are located at the groove 12, preventing from damage and maintaining aesthetics of the suitcase 100.

Finally, it should be noted that the above embodiments are merely to exemplarily describe technical solutions of the disclosure and are not used to limit the disclosure. Although the disclosure has been described in detail by referring to the aforementioned embodiments, those skilled in the art should understand that they may still modify the technical solutions of the above-mentioned embodiments or equivalently substitute some or all of technical features of the above-mentioned embodiments to form corresponding technical solutions. Such modifications or substitutions shall not make the essence of the corresponding technical solutions depart from the scope of the technical solutions of the above-mentioned embodiments of the disclosure.

What is claimed is:

1. A suitcase telescopic handle, comprising: telescopic rods (1), a handlebar (2), and a hanging rod assembly;

wherein the telescopic rods (1) are two in quantity, the telescopic rods (1) are connected to two ends of the handlebar (2) respectively, and the telescopic rods (1) are installed on a body of a suitcase (14);

the hanging rod assembly comprises a sliding connector and a pair of fixed connectors, the pair of fixed connectors are arranged opposite to each other to define a gap (3) therebetween, the sliding connector is slidably connected to one of the pair of fixed connectors, the sliding connector is capable of closing the gap (3) by sliding toward another of the pair of fixed connectors, and the sliding connector is capable of opening the gap (3) by sliding away from the another of the pair of fixed connectors; and the pair of fixed connectors are connected to the two ends of the handlebar (2) respectively to make the hanging rod assembly and the handlebar (2) form a closed frame structure configured to hang items; or the pair of fixed connectors are connected to the telescopic rods (1) respectively to make the hanging rod assembly, the telescopic rods (1) and the handlebar (2) form a closed frame structure configured to hang the items.

2. The suitcase telescopic handle as claimed in claim 1, wherein the pair of fixed connectors are fixed rods (4), and the sliding connector is a sliding sleeve (5); and an end of the sliding sleeve (5) is sleeved onto one of the fixed rods (4); another end of the sliding sleeve (5) is capable of being sleeved onto another of the fixed rods (4) to close the gap (3) by sliding toward the another of the fixed rods (4); and the another end of the sliding sleeve (5) is capable of being disengaged from the another of the fixed rods (4) to open the gap (3) by sliding away from the another of the fixed rods (4).

3. The suitcase telescopic handle as claimed in claim 1, wherein the pair of fixed connectors are fixed sleeves (6), and the sliding connector is a sliding rod (7); and an end of the sliding rod (7) is inserted into one of the fixed sleeves (6), another end of the sliding rod (7) is capable of being inserted into another of the fixed sleeves (6) to close the gap (3) by sliding toward the another of the fixed sleeves (6); and the another end of the sliding rod (7) is capable of being disconnected from the another of the fixed sleeves (6) to open the gap (3) by sliding away from the another of the fixed sleeves (6).

4. The suitcase telescopic handle as claimed in claim 1, wherein the hanging rod assembly further comprises a spring (8); and the spring (8) is disposed between the sliding connector and the one of the pair of fixed connectors slidably connected to the sliding connector, and the spring (8) is configured to provide a force to drive the sliding connector to slide toward the another of the pair of fixed connectors.

5. The suitcase telescopic handle as claimed in claim 1, wherein the hanging rod assembly further comprises a protruding part (9) disposed on the sliding connector, and the protruding part (9) is located within the closed frame structure.

6. The suitcase telescopic handle as claimed in claim 1, wherein when the telescopic rods (1) are retracted relative to a suitcase (100), a clearance (11) is defined between the hanging rod assembly and a top surface of the suitcase.

7. The suitcase telescopic handle as claimed in claim 1, wherein the suitcase telescopic handle further comprises a handle base (13), the handle base (13) is disposed on the body of the suitcase (14), and the telescopic rods (1) are disposed on the handle base (13); and when the telescopic rods (1) are retracted relative to the handle base (13), a clearance (11) is defined between the hanging rod assembly and the handle base (13).

8. A suitcase (100), comprising: the suitcase telescopic handle as claimed in claim 1 and the body of the suitcase (14).

9. The suitcase (100) as claimed in claim 8, wherein the suitcase telescopic handle is disposed on one of a front side surface and a rear side surface of the body of the suitcase (14).

10. The suitcase (100) as claimed in claim 9, wherein a groove (12) is defined on a top surface of the body of the suitcase (14), the suitcase telescopic handle is located at the groove (12), and the groove (12) is configured to accommodate the handlebar (2) and the hanging rod assembly.

* * * * *